US009277820B2

(12) United States Patent
Jacob et al.

(10) Patent No.: US 9,277,820 B2
(45) Date of Patent: Mar. 8, 2016

(54) STABILIZING MECHANISM FOR A SHELF ASSEMBLY

(71) Applicant: Wipro Limited, Bangalore (IN)

(72) Inventors: Jejju Jacob, Chennai (IN); Puneet Makkar, Krishna Nagar (IN)

(73) Assignee: Wipro Limited, Bangalore (IN)

( * ) Notice: Subject to any disclaimer, the term of this patent is extended or adjusted under 35 U.S.C. 154(b) by 53 days.

(21) Appl. No.: 14/299,823

(22) Filed: Jun. 9, 2014

(65) Prior Publication Data

US 2015/0313360 A1 Nov. 5, 2015

(30) Foreign Application Priority Data

Apr. 30, 2014 (IN) ..... 2178/CHE/2014

(51) Int. Cl.
*A47G 29/02* (2006.01)
*A47B 96/07* (2006.01)
*A47F 5/00* (2006.01)

(52) U.S. Cl.
CPC ..... *A47B 96/07* (2013.01); *A47F 5/0081* (2013.01)

(58) Field of Classification Search
CPC ..... A47B 96/07; A47F 5/0081
USPC ..... 248/241, 242, 243, 244, 298.1; 108/108, 147.11, 147.16, 147.17; 312/408
See application file for complete search history.

(56) References Cited

U.S. PATENT DOCUMENTS 2,841,459 A 7/1958 Sharpe
3,172,715 A 3/1965 Powder
3,212,836 A 10/1965 Johnson
3,467,352 A * 9/1969 Bohler ..... A47C 3/28 248/125.1
3,640,498 A 2/1972 Aleks
3,865,337 A * 2/1975 Towfigh ..... A47B 57/56 248/246
3,885,846 A 5/1975 Chuang et al.
4,022,136 A * 5/1977 Schott ..... A47B 3/00 108/108
4,508,302 A * 4/1985 Hausser ..... D05B 75/06 182/146
4,575,702 A 3/1986 Nitta et al.
4,614,273 A * 9/1986 Ishii ..... A47B 57/56 211/183
4,688,686 A 8/1987 Mitts et al.
5,266,914 A 11/1993 Dickson et al.
5,362,145 A 11/1994 Bird et al.
6,065,821 A 5/2000 Anderson et al.
7,178,890 B2 2/2007 Park et al.
8,226,184 B2 7/2012 Kang et al.
2010/0176704 A1 7/2010 Kim

FOREIGN PATENT DOCUMENTS

EP 2250928 A1 11/2010
WO 0249495 A1 6/2002
WO 2010091949 A2 8/2010

* cited by examiner

*Primary Examiner* — Gwendolyn Baxter
(74) *Attorney, Agent, or Firm* — LeClairRyan, a Professional Corporation

(57) ABSTRACT

A stabilizing mechanism for a shelf assembly, the stabilizing mechanism comprising at least one movable rail placed between at least two support rails and a frame comprising of at least one shelf of the shelf assembly. At least one guide wheel pivotably mounted to a shaft having at least one shaft arms, wherein the at least one guide wheel and the shaft arms are configured to slide along the entire length of the at least one movable rail while adjusting the height of the at least one shelf in a vertical direction. A first slider member connected to the shaft at one end and configured to slide in lateral slots provided on the frame of the shelf for stabilizing the shelf.

12 Claims, 3 Drawing Sheets

STABILIZING MECHANISM FOR A SHELF ASSEMBLY

This application claims the benefit of Indian Patent Application Serial No. 2178/CHE/2014, filed Apr. 30, 2014, which is hereby incorporated by reference in its entirety.

FIELD OF THE INVENTION

The present disclosure generally relates to a shelf mechanism. In particular, embodiments of the present disclosure relates to a mechanism and a method for stabilizing the shelf of a shelf assembly.

BACKGROUND OF THE INVENTION

Shelf assembly finds its application in a variety of domestic and industrial applications. Generally, shelves of the shelf assembly are storage units which may be either temporarily connected to the shelf assembly or permanently fixed to the shelf assembly. The shelf of the storage units may be used in, but not limited to, cupboards, almirahs, shoe racks, refrigerators, inventory storage racks, supermarkets racks and grocery storage racks etc. The shelves are generally flat structures and are used to store and/or display objects placed onto the shelves. Typically the shelves are supported or hinged/pivoted at side walls of the shelf assembly in order to provide stable support for the shelves. The shelves which are hinged are less stable when compared with the shelves which are supported structure. The shelves in many applications tend to get loaded at different locations on the shelf. Sometimes, by virtue of object's weight, load acting on the shelves may exceed the normal load withstanding capacities of the shelf.

For the hinged shelves, the loading or unloading of the shelves may lead to imbalances in the shelf and thereby the entire shelf assembly. Also, sometimes, the shelves have to be dismantled or removed from the shelf assembly for various activities such as transportation, maintenance/cleaning etc. Some of the shelves are also designed such that, they may be rearranged to vary the height or level within the space available in cabinet of the shelf assembly using suitable actuation means. During actuation of such shelves, load placed over each of the shelves tend to tilt the entire shelf causing the loads to tip over or fall off from the shelf. During such a scenario, the load or the articles placed over the shelf gets displaced or prone to break due to the sudden change in displacement of the shelf. Moreover, the tilting effect acting on the shelf causes even more ordeal to the shelf assembly due to the collapse of the shelves. Also, when a shelf tilts on its axis, the objects placed on the shelf are thrown to the lower level shelves causing damage.

For example, in refrigerators, there are a number of shelves installed in various levels of the refrigerator compartment. Storing different articles with varied dimensions and volumes in the various shelves of the refrigerator is possible by adjusting, and re-ordering the shelves of the refrigerator. During this process, the shelf is in a free fall motion and there are possibilities with the shelf tilting to its sides. Thus adjusting the shelves in the refrigerator demands the user to maintain equilibrium of the loads placed on the shelf during movement. Also, the user has to make sure that, the shelves do not tilt and cause damage to the articles placed on the shelf.

Hence, there is a need for an adjustable shelf assembly to have an anti-tilt mechanism which prevents the shelves from tilting during the movement of the shelf.

SUMMARY OF THE INVENTION

One or more shortcomings of the prior art are overcome and additional advantages are provided through the present disclosure. Additional features and advantages are realized through the techniques of the present disclosure. Other embodiments and aspects of the disclosure are described in detail herein and are considered a part of the claimed disclosure.

Accordingly, the present disclosure relates to a stabilizing mechanism for a shelf assembly is provided. The stabilizing mechanism comprises at least one movable rail placed between at least two support rails and a frame comprising at least one shelf of the shelf assembly. The stabilizing mechanism comprises at least one guide wheel which is pivotably mounted to a shaft having at least one shaft arms. The at least one guide wheel and the shaft arms are configured to slide along the entire length of the at least one movable rail while adjusting the height of the at least one shelf in a vertical direction. The stabilizing mechanism comprises a first slider member which is connected to the shaft at one end and configured to slide in lateral slots provided in the frame of the shelf for stabilizing the shelf.

In an aspect of the present disclosure, a method for stabilizing the shelf assembly is provided. The method comprises acts of sliding the first slider member in the lateral slots provided on the shelf which allows movement of the slider member for stabilizing the shelf and thereby preventing tilting of the shelf while operating the shelf.

It is to be understood that the aspects and embodiments of the invention described above may be used in any combination with each other. Several of the aspects and embodiments may be combined together to form a further embodiment of the disclosure.

The foregoing summary is illustrative only and is not intended to be in any way limiting. In addition to the illustrative aspects and features described above, further aspects, and features will become apparent by reference to the drawings and the following detailed description.

BRIEF DESCRIPTION OF THE DRAWINGS

The novel features and characteristic of the disclosure are set forth in the appended claims. The embodiments of the disclosure itself, however, as well as a preferred mode of use, further objectives and advantages thereof, will best be understood by reference to the following detailed description of an illustrative embodiment when read in conjunction with the accompanying drawings. One or more embodiments are now described, by way of example only, with reference to the accompanying drawings.

Figure 1A:
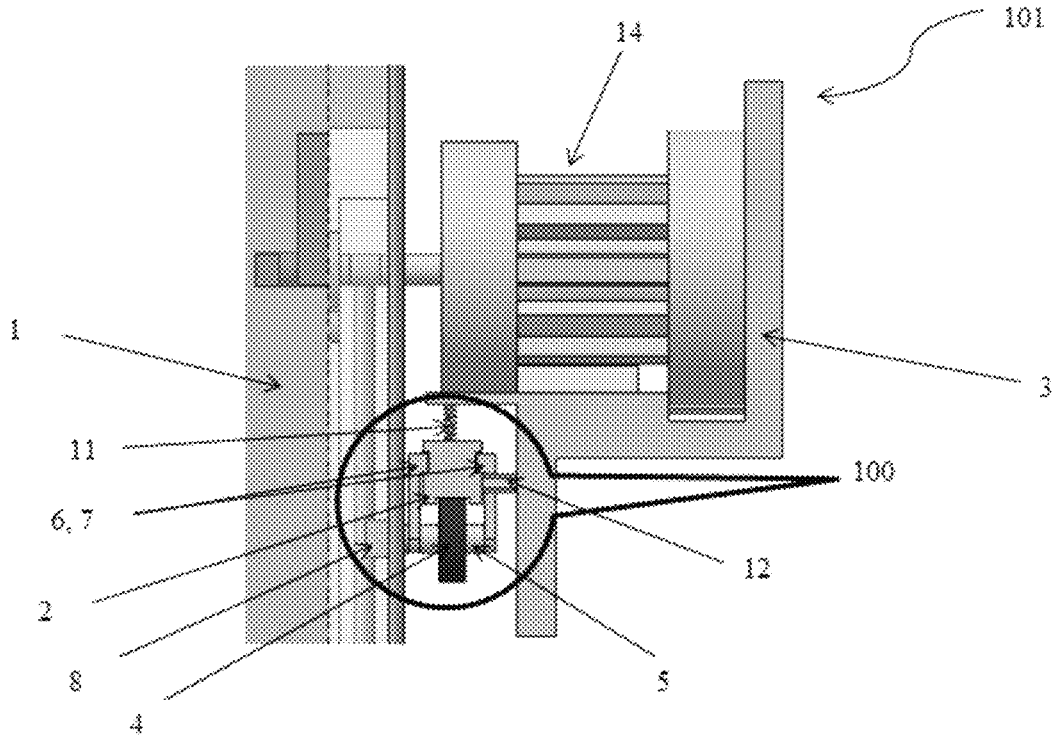
FIG. 1*a* illustrates a top view of a stabilizing mechanism installed in each of the at least two support rails in accordance with some embodiment of the present disclosure.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION OF THE INVENTION

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiment thereof has been shown by way of example in the drawings and will be described in detail below. It should be understood, however that it is not intended to limit the disclosure to the particular forms disclosed, but on the contrary, the disclosure is to cover all modifications, equivalents, and alternative falling within the spirit and the scope of the disclosure.

The terms "comprises", "comprising", or any other variations thereof, are intended to cover a non-exclusive inclusion, such that a setup, device or method that comprises a list of components or steps does not include only those components or steps but may include other components or steps not expressly listed or inherent to such setup or device or method. In other words, one or more elements in a system or apparatus proceeded by "comprises . . . a" does not, without more constraints, preclude the existence of other elements or additional elements in the system or apparatus.

Accordingly, the present disclosure relates to a stabilizing mechanism for a shelf assembly is provided. The stabilizing mechanism comprises at least one movable rail placed between at least two support rails and a frame comprising at least one shelf of the shelf assembly. The stabilizing mechanism comprises at least one guide wheel which is pivotably mounted to a shaft having at least one shaft arms. The at least one guide wheel and the shaft arms are configured to slide along the entire length of the at least one movable rail while adjusting the height of the at least one shelf in a vertical direction. The stabilizing mechanism comprises a first slider member which is connected to the shaft at one end and configured to slide in lateral slots provided in the frame of the shelf for stabilizing the shelf.

In the following detailed description of the embodiments of the disclosure, reference is made to the accompanying drawings that form a part hereof, and in which are shown by way of illustration specific embodiments in which the disclosure may be practiced. These embodiments are described in sufficient detail to enable those skilled in the art to practice the disclosure, and it is to be understood that other embodiments may be utilized and that changes may be made without departing from the scope of the present disclosure. The following description is, therefore, not to be taken in a limiting sense.

Figure 1B:
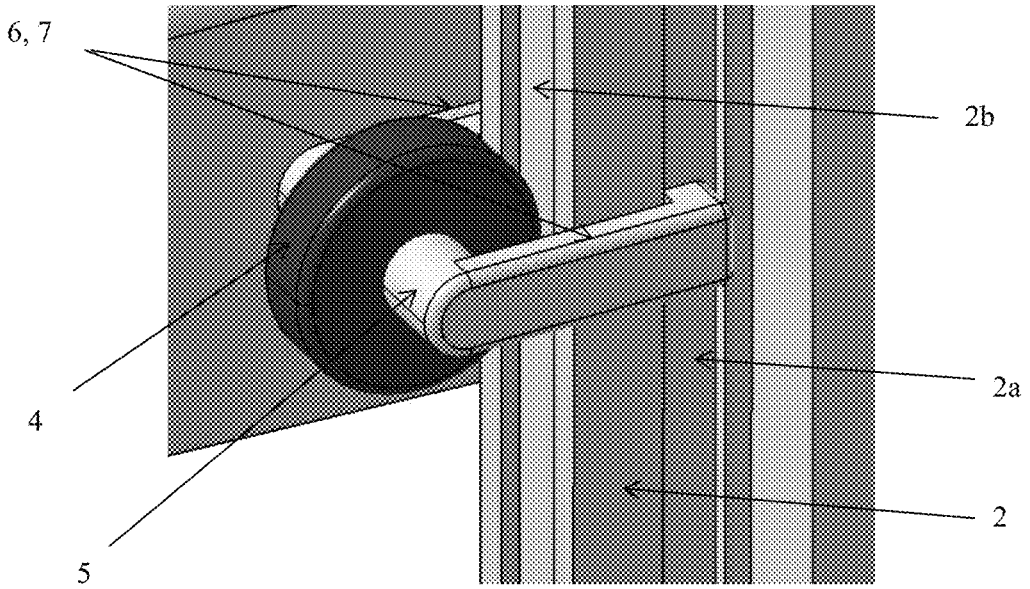
FIG. 1*b* illustrates perspective view of the guide wheel and the guide paths of the movable rail in accordance with some embodiment of the present disclosure.

FIG. 1*a* illustrates the stabilizing mechanism 100 installed in each of the at least two support rails 3 of a shelf assembly 101 in accordance with some embodiment of the present disclosure. The stabilizing mechanism 100 consists of a movable rail 2 placed between the support rail 3 and the shelf 1 of the shelf assembly 101. At least one guide wheel 4 is tracked on to the guide paths 2*b* of the movable rail 2 as clearly shown in FIG. 1*b*. The guide wheel 4 is mounted on a shaft 5 such that the shaft 5 acts as an axle aiding rotational movement to the guide wheel 4. One end of the shaft 5 is provided with a first slider member 8 which is configured to slide in lateral slots 9, 10. The lateral slots 9, 10 are provided in the frame of the shelf 1. The lateral slots 9, 10 are designed such that the first slider member 8 firmly fits into the lateral slots 9, 10. The shaft 5 is held in place by the shaft arms 6, 7, wherein the ends of the shaft arms 6, 7 are tracked on to the guide paths 2*a* provided on the sides of the movable rail 2. The shaft arms 6, 7 tracked on the guide paths 2*a* slide along the entire length of the guide paths 2*a* when the shelf 1 is actuated in a vertical direction.

The movable rail 2 comprises at least one detachable resilient member 11, wherein one end of the detachable resilient member 11 is fixed at rear end of the movable rail 2 and the other end is fixed to the at least two support rails 3. In one embodiment, the detachable resilient member 11 is a helical spring member which generates retraction force on the movable rail 2 to retract the movable rail 2 to its initial position once the load on the shelf 1 is removed. In an embodiment of the present disclosure, the detachable resilient member 11 is any one of but not limited to a helical spring having a constant spring force, spiral spring, an elastic band or any type of retraction belt and any such member which serves the purpose. The detachable resilient member 11 is selected based on the load bearing capacity of each shelf 1. The detachable resilient member 11 equipped in each of the shelf 1 has a retraction force which can be calibrated according to the load acting on the shelf 1.

Further, the movable rail 2 extends along the entire length of the support rails 3. The ends of the movable rail 2 are provided with a second slider member 12. The second slider member 12 is fixed to the ends of the movable rail 2 at the sides of the movable rail 2 adjacent to the guide paths 2*a*. The second slider member 12 fixed on to the movable rail 2 such that, the other end fits firmly into a second slot 13. When a predetermined amount of load is placed anywhere on the shelf 1, the shelf 1 tilts in the direction of the load. For example, on application of 2 kg of load on the shelf 1 at a front end of the shelf 1 the tilting of the shelf 1 occurs in the direction of the load. The first slider member 8 and the second slider member 12 moves laterally, in a direction of the load within the first lateral slots 9, 10 and the second slot 13. The first lateral slots 9, 10 are provided on the shelf 1 on to which the first slider member 8 slides in a lateral direction along the direction of the load. The first lateral slots 9, 10 and second slots 13 prevent tilting of the shelf 1 and prevent the articles stored on the shelf 1 from tipping over. Moreover, the first slots 9, 10 and the second slots 13 act as stopper means which prevent tilting of the shelf 1.

Figure 2:
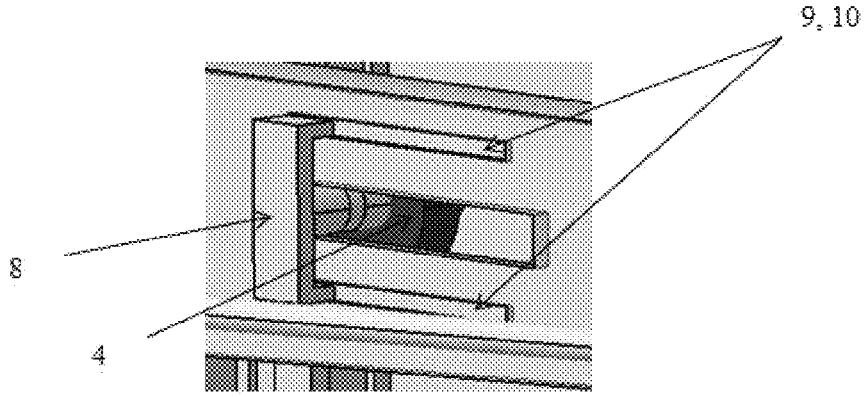
FIG. 2 illustrates a perspective view of the lateral slots configured in the frame of the shelf and first slider member slidably placed in the lateral slots in accordance with some embodiment of the present disclosure.

FIG. 2 illustrates perspective view of the lateral slots 9, 10 and the first slider member 8 in accordance with some embodiments of the present disclosure. The first slider member 8 is installed within the lateral slots 9, 10 provided in the frame of the shelf 1. The lateral slots 9, 10 are slotted in a lateral direction so as to allow only longitudinal movement of the first slider member 8 up to a predetermined distance. For example, the first slider member 8 slides within the lateral slots 9, 10 up to a maximum distance of the slot provided. On application of load on any part of the shelf 1, the movable rail 2 moves longitudinally in the direction of the load. Due to the movement of the movable rail 2, the guide wheel 4 tracked on to the guide paths 2*b* moves longitudinally in the direction of the load. The first slider member 8 fixed to the shaft 5 of the guide wheel 4 moves within the lateral slots 9, 10 up to a predetermined distance.

Figure 3:
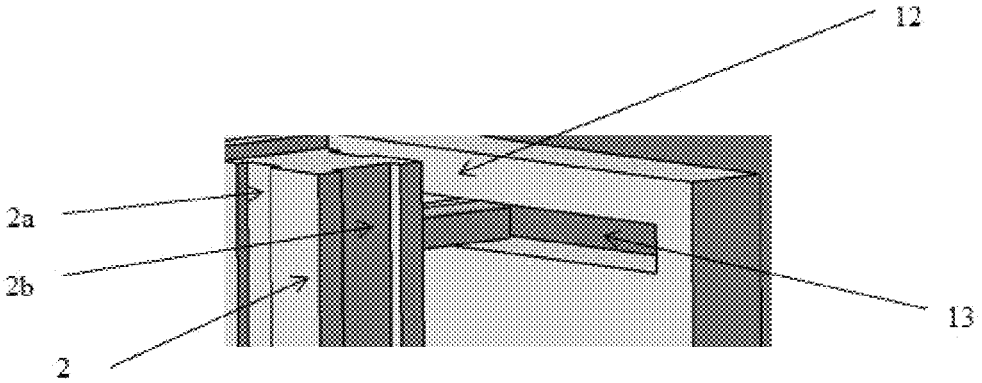
FIG. 3 illustrates a perspective view of second slider member provisioned to slide within second slot configured in the support rails in accordance with some embodiment of the present disclosure.

FIG. 3 illustrates perspective view of the second slider member 12 configured to slide within the second slot 13 in accordance with some embodiments of the present disclosure. One end of the movable rail 2 is fixed with a second slider member 12 which moves longitudinally within the second slot 13. The second slot 13 aids in restricting excess movement of the second slider member 12. The movable rail 2 consists of guide paths 2*a*, 2*b* provided at the front and side faces of the movable rail 2. The guide paths 2*b* provided on the front face of the movable rail 2 tracks the guide wheel 4 along the entire length of the movable rail 2. The guide paths 2*a* provided on the sides of the movable rail 2 help in sliding of the shaft arms 6, 7 along the entire length of the movable rail 2.

Figure 4:
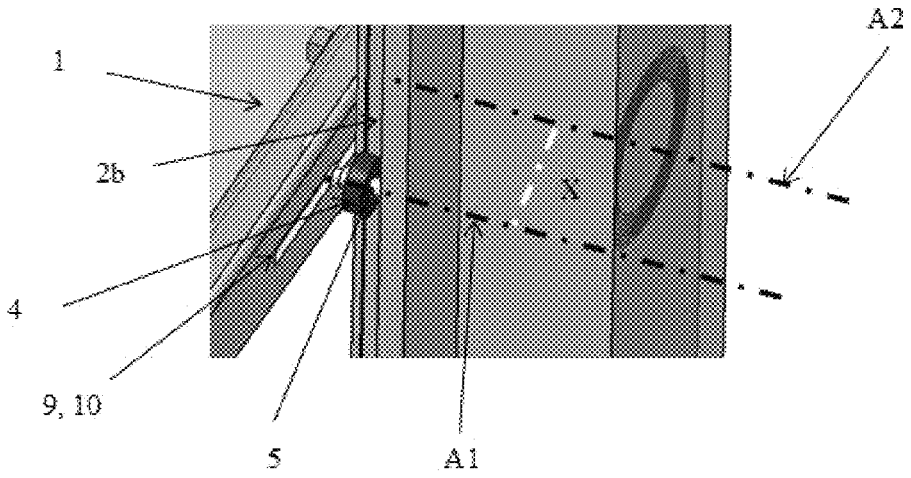
FIG. 4 illustrates a perspective view of the axis A1 and axis A2 with the guide wheel installed on the guide paths in accordance with some embodiment of the present disclosure.

FIG. 4 illustrates perspective view of the axis A1 and axis A2 with the guide wheel 4 installed on the guide paths 2*b* in accordance with some embodiments of the present disclosure. The axis A1 of the guide wheel 4 is adjacent to the axis A2 of the actuation mechanism 14. When a predetermined load is applied on the shelf 1 of the shelf assembly 101, the shelf 1 tilts in the direction of the load applied. The lateral slots 9, 10 provided on the shelf 1 allow lateral movement of the first slider member 8. The guide wheel 4 is tracked on the guide paths 2*b* provided on the front face of the movable rail 2. The guide wheel 4 tracks along the entire length of the guide path 2*b* on actuation of the shelf 1.

In an embodiment of the present disclosure, the distance X between the axis A1 of the guide wheel 4 and axis A2 of the actuation mechanism 14 increases when the predetermined load applied on the shelf 1 is acting on the front end of the shelf 1. The movable rail 2 moves in the direction of the load due to the tilting of the shelf 1.

In an embodiment of the present disclosure, the distance X between the axis A1 of the guide wheel 4 and the axis A2 of the actuation mechanism 14 decreases when the predetermined load applied on the shelf 1 is acting on the rear end of the shelf 1. The movable rail 2 moves in the direction of the load due to the tilting of the shelf 1.

In an embodiment of the present disclosure, the distance X between the axis A1 of the guide wheel 4 and the axis A2 of the actuation mechanism 14 remains constant if the predetermined load applied on the shelf 1 is acting at the center of the shelf 1. Also, if the predetermined load applied on the shelf at any given point is removed, the distance X between the axis A1 and axis A2 remains constant.

In an embodiment of the present disclosure, the actuation mechanism 14 fixed to the shelf 1 actuates the shelf 1 for movement of the shelf 1 in vertical direction. The actuation mechanism 14 is at least one of rack and pinion mechanism, geared mechanism, belt mechanism and the like.

Figure 5A:
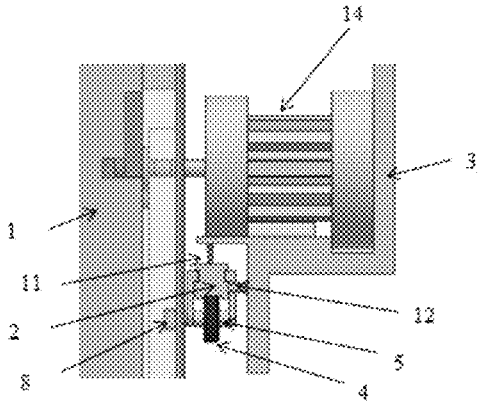
FIGS. 5*a* and 5*b* illustrates working process of the stabilizing mechanism in accordance with some embodiment of the present disclosure.

FIG. 5*a* illustrates a top view of the stabilizing mechanism 100 when the shelf of the shelf assembly 101 is balanced during working process of the stabilizing mechanism 100 in accordance with an embodiment of the present disclosure. The shelf is in horizontal position, wherein there is no imbalance of load onto the shelf and the first slider member is located at center or middle length of the lateral slots 9, 10.

Figure 5B:
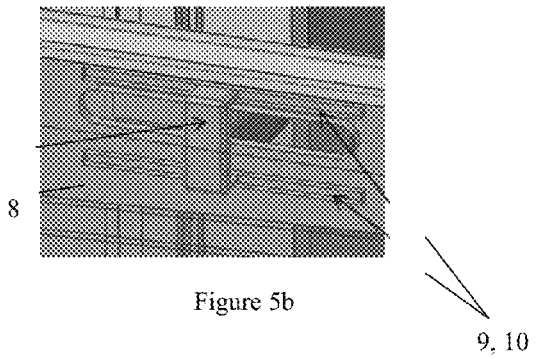

FIG. 5*b* illustrates perspective view of the frame of the shelf 1 comprising lateral slots 9, 10 for lateral movement of the first slider member 8. The first slider member 8 is configured to slide in the lateral slots during displacement of the shelf 1 due to loading or unloading of the objects on the shelf 1. The first slider member 8 is at a central position within the lateral slots 9, 10 when the predetermined load on the shelf 1 is balanced or when there is no load acting on the shelf 1.

Figure 5C:
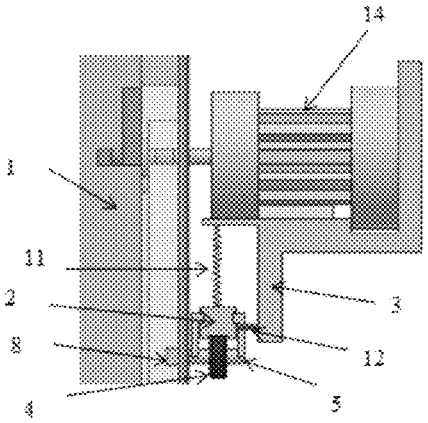
FIGS. 5*c* and 5*d* illustrates working process of the stabilizing mechanism in accordance with some embodiment of the present disclosure.

FIG. 5*c* illustrates top view of the stabilizing mechanism 100 when the shelf 1 of the shelf assembly 101 is balanced during working process of the stabilizing mechanism 100 in accordance with some embodiments of the present disclosure. The first slider member 8 is at a front end position within the lateral slots 9, 10 when the predetermined load is acting on front end of the shelf 1 and the detachable resilient member 12 is in an expanded state.

Figure 5D:
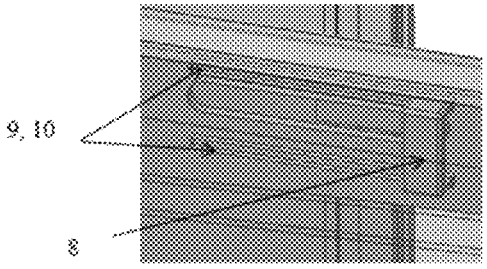

FIG. 5*d* illustrates perspective view of the frame of the shelf 1 comprising lateral slots 9, 10 for lateral movement of the first slider member 8. The first slider member 8 is configured to slide in the lateral slots 9, 10 during displacement of shelf due to loading or unloading of the objects on the shelf 1. The first slider member 8 is at one end position within the lateral slots 9, 10 when the predetermined load is acting on front end of the shelf 1.

Figure 5E:
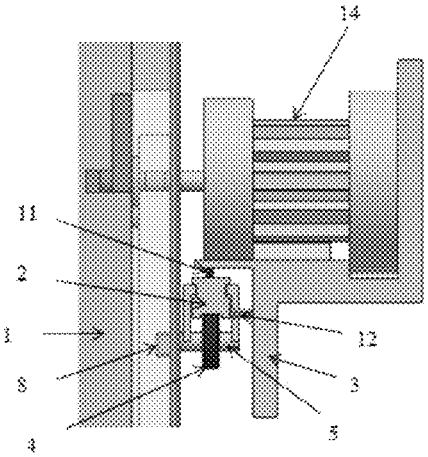
FIGS. 5*e* and 5*f* illustrates working process of the stabilizing mechanism in accordance with some embodiment of the present disclosure.

FIG. 5*e* illustrates a top view of the stabilizing mechanism 100 when the shelf 1 of the shelf assembly 101 is balanced during working process of the stabilizing mechanism 100 in accordance with an embodiment of the present disclosure. The shelf is in a horizontal position, wherein there is no imbalance of load on the shelf 1 and the first slider member 8 is located at center or middle length of the lateral slots 9, 10. The detachable resilient member 12 is in a non-working state. (i.e neither expanded nor compressed).

Figure 5F:
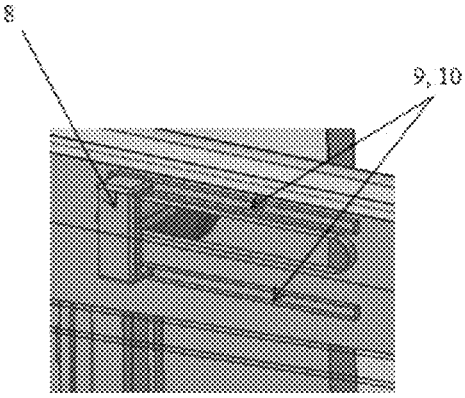

FIG. 5*f* illustrates working process of the stabilizing mechanism 100 in accordance with some embodiments of the present disclosure. The first slider member 8 is at a rear end position within the lateral slots 9, 10 when the predetermined load is acting on rear end of the shelf 1 and the detachable resilient member 12 is in a compressed state.

In one embodiment of the present disclosure, the movement of the shelf 1 may be moved in direction includes, but not limited to, a longitudinal direction, horizontal direction, lateral direction and vertical direction.

Advantages

In one embodiment of the present disclosure, the anti-tilt mechanism reduces the effort of the user when the shelves of the shelf assembly have to be displaced.

In one embodiment of the present disclosure, the anti-tilt mechanism prevents tilting of the shelf and prevents accidental tip over of the articles from the shelf and free fall of the shelf.

INDUSTRIAL APPLICABILITY

In an embodiment of the present disclosure, the stabilizing mechanism for a shelf assembly finds its potential application in refrigerators. However, the stabilizing mechanism can also find it applications in devices such as book shelves, storage racks, shoe racks, inventory storage rooms, storage cabinets, cupboards etc.

EQUIVALENTS

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based here on. Accordingly, the disclosure of the embodiments of the invention is intended to be illustrative, but not limiting, of the scope of the invention, which is set forth in the following claims.

The terms "an embodiment", "embodiment", "embodiments", "the embodiment", "the embodiments", "one or more embodiments", "some embodiments", and "one embodiment" mean "one or more (but not all) embodiments of the invention(s)" unless expressly specified otherwise.

The terms "including", "comprising", "having" and variations thereof mean "including but not limited to", unless expressly specified otherwise. The enumerated listing of items does not imply that any or all of the items are mutually exclusive, unless expressly specified otherwise.

The terms "a", "an" and "the" mean "one or more", unless expressly specified otherwise.

A description of an embodiment with several components in communication with each other does not imply that all such components are required. On the contrary a variety of optional components are described to illustrate the wide variety of possible embodiments of the invention.

The foregoing description of various embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

In addition, where features or aspects of the disclosure are described in terms of Markush groups, those skilled in the art will recognize that the disclosure is also thereby described in terms of any individual member or subgroup of members of the Markush group.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed:

1. A stabilizing mechanism for a shelf assembly, the stabilizing mechanism comprising:

at least one movable rail placed between at least two support rails and a frame comprising of at least one shelf of the shelf assembly;

at least one guide wheel pivotably mounted to a shaft having at least one shaft arm, wherein the at least one guide wheel and the at least one shaft arm are configured to slide along the entire length of the at least one movable rail while adjusting the height of the at least one shelf in a vertical direction; and a first slider member connected to the shaft at one end and configured to slide in lateral slots provided in the frame of the shelf for stabilizing the shelf.

2. The stabilizing mechanism as set forth in claim 1, wherein the at least one movable rail is configured with a plurality of guide paths along a length of the at least one movable rail such that the shaft arms and the shaft slide on the guide paths.

3. The stabilizing mechanism as set forth in claim 1, wherein the at least one movable rail is configured with a plurality of guide paths along a length of the at least one movable rail such that the at least one guide wheel moves on the guide paths.

4. The stabilizing mechanism as set forth in claim 1 further comprising:

at least one detachable resilient member connected in between the at least one movable rail and the at least two support rails to retract the at least one movable rail.

5. The stabilizing mechanism as set forth in claim 4, wherein the at least one detachable resilient member is at least one of a spring member, an elastic band, or a retraction belt.

6. The stabilizing mechanism as set forth in claim 5, wherein the spring member is at least one of helical spring member or a spiral spring member.

7. The stabilizing mechanism as set forth in claim 1 further comprising:

at least one second slider member fixed on the at least one movable rail for supporting and allowing lateral movement of the at least two movable rails.

8. The stabilizing mechanism as set forth in claim 7, wherein the at least one second slider member moves within at least one second slot provided on the at least two support rails.

9. The stabilizing mechanism as set forth in claim 1, wherein the at least one guide wheel is placed co-axially to at least one actuation mechanism of the shelf assembly.

10. The stabilizing mechanism as set forth in claim 9, wherein a distance between an axis of the at least one guide wheel and an axis of the at least one actuation mechanism varies with application of a load on the shelf.

11. The stabilizing mechanism as set forth in claim 9, wherein the at least one actuation mechanism fixed to the at least one shelf displaces the at least one shelf in a vertical direction.

12. The stabilizing mechanism as set forth in claim 11, wherein the actuation mechanism is at least one of a rack and pinion mechanism, a geared mechanism, or a belt mechanism.

* * * * *